United States Patent [19]

Allen

[11] 4,377,472

[45] Mar. 22, 1983

[54] PHOSPHATE FLOTATION

[75] Inventor: Howard L. Allen, Lithia, Fla.

[73] Assignee: W. R. Grace & Co., New York, N.Y.

[21] Appl. No.: 956,701

[22] Filed: Nov. 1, 1978

Related U.S. Application Data

[63] Continuation of Ser. No. 711,287, Aug. 3, 1976, abandoned.

[51] Int. Cl.[3] ..... B03D 1/14

[52] U.S. Cl. ..... 209/166; 209/9

[58] Field of Search ..... 209/166

[56] References Cited

U.S. PATENT DOCUMENTS

| | | | |
|---|---|---|---|
| 2,327,408 | 8/1943 | Ellis | 209/166 |
| 2,341,046 | 2/1944 | Kirby | 209/166 |
| 2,466,995 | 4/1949 | McMurray | 209/167 |
| 2,633,240 | 3/1953 | Bishop | 209/166 |
| 2,666,588 | 1/1954 | Schack | 209/166 X |
| 2,740,522 | 4/1956 | Aimone | 209/166 |
| 3,371,778 | 3/1968 | Iwasaki | 209/3 |
| 3,403,783 | 10/1968 | Andery | 209/167 |
| 3,456,790 | 7/1969 | Fast | 209/166 |
| 3,862,028 | 1/1975 | Jones | 209/166 |
| 4,008,151 | 2/1977 | Smaui | 209/9 |

FOREIGN PATENT DOCUMENTS

| | | | |
|---|---|---|---|
| 655810 | 8/1951 | United Kingdom | 209/166 |

*Primary Examiner*—Norman Yudkoff

*Attorney, Agent, or Firm*—W. W. McDowell, Jr.; P. M. Pippenger

[57] ABSTRACT

Use of reverse flotation for phosphate rock ore treatment, wherein starch is added first to depress phosphate rock particles, followed by addition of cationic reagent, e.g., amine to float the silica. Phosphate rock is recovered as sink concentrate and silica is recovered as float tailings.

13 Claims, 1 Drawing Figure

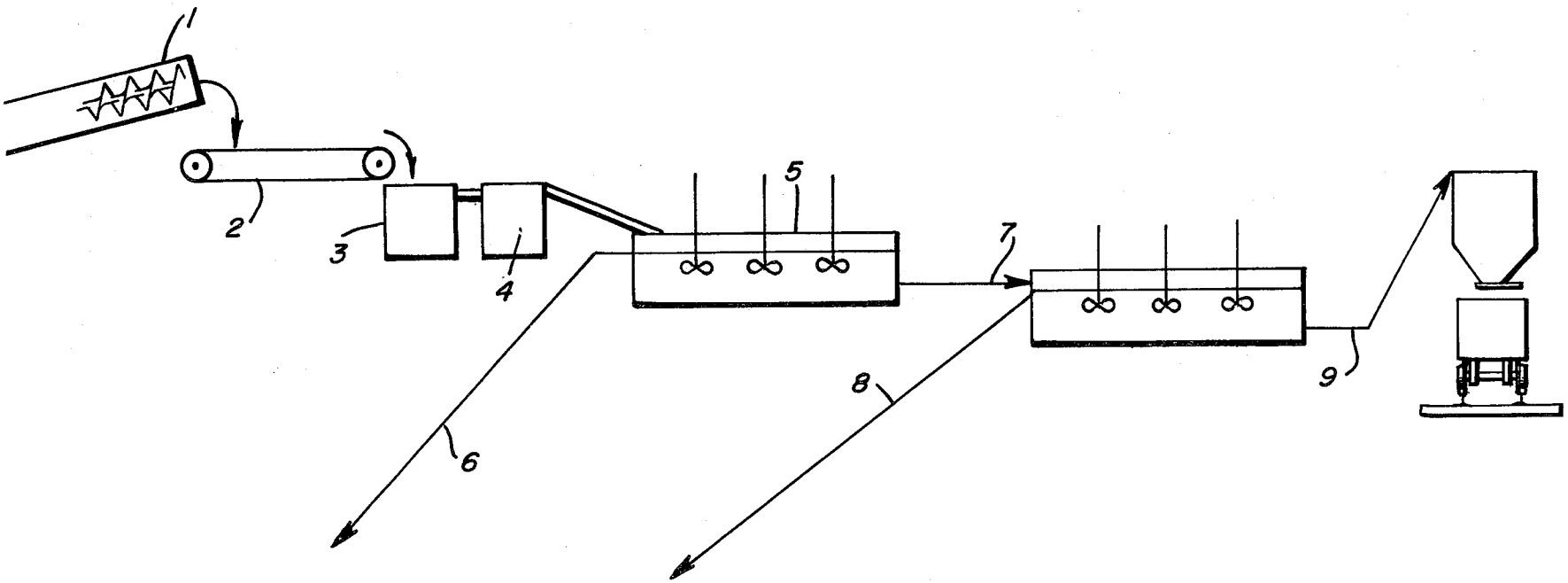
1
2
3
4
5
6
7
8
9

PHOSPHATE FLOTATION

This is a continuation of application Ser. No. 711,287, filed Aug. 3, 1976 now abandoned.

This invention is directed to a novel process for the flotation of phosphate ores, to recover phosphate ore as the concentrate. It is a type of flotation known as "reverse flotation", since the tailings (quartz or silica particles) are floated, and the desired ore, namely phosphate rock particles, sink and become the concentrate. The silica is, in fact, present in a much greater amount than the phosphate rock. Typically a feed is used comprising about 70% silica (quartz), the balance being mostly phosphate rock particles with a little clay.

My new process can be used as a one-stage flotation operation, or it can be used in two or more stages. It is carried out rather simply, i.e., first, by adding starch to the feed slurry, whereby phosphate particles are depressed, secondly, a cationic collector reagent (e.g., an amine) of the type conventionally used in phosphate froth flotation is added to the starch-treated slurry. Then the feed is subjected to flotation. Phosphate particles sink and are recovered as concentrate. Recovery of BPL values is excellent, being typically within the range of 80–90%, ore more, representing the percentage of the BPL recovered which was originally in the feed. These figures compare with a typical recovery range of 60–80% BPL recovered in conventional phosphate flotation processes in the United States.

My recovered concentrates typically analyze about 60–80% BPL, thus comparing favorably with concentrates obtained by the conventional two-stage froth flotation process, which typically analyze about 66–81% BPL. Although BPL in my final concentrate may on occasion be slightly less than that of the conventional 2-step concentrate, this is more than counter balanced by my much higher BPL recovery.

It is known to use reverse flotation with certain hematite ores, wherein starch is added to depress the hematite, followed by addition of amine to float the silica. However, so far as I am aware this type of reverse flotation has never been used for phosphate rock flotation.

In the United States, commercial phosphate rock flotation proceeds in two stages. In the first stage the ore is conditioned with an anionic collector, typically a fatty acid. This coats the particles of phosphate, and they float to provide a rougher concentrate. Silica (quartz) sinks and goes to general mill tailings. The rougher concentrate still contains considerable silica. To reduce the amount of silica the rougher concentrate is treated with an amine. In the cleaner cells the silica floats and goes to tailings, and the phosphate sinks and is recovered as cleaner concentrate analyzing about 66 to 81% BPL. Overall recovery of BPL is 60–80%. The BPL values not recovered are lost in the tailings. Thus, using conventional practice, ⅓ of the BPL in phosphate rock subjected to flotation is lost and returned to the ground. The instant invention reduces that loss substantially.

The FIGURE shows a simplified schematic flowsheet of one embodiment of the invention.

The following examples illustrate without limiting the invention.

EXAMPLES 1–6

For each of the following six examples bench scale equipment was used. The flotation apparatus was a laboratory flotation cell (a small laboratory model of Mineral Separation type unit, of approximately 2 gallon cell capacity, capable of running 2 lbs. feed samples.) One-pound samples of wet phosphate ore were used, consisting of about 75% solids and 25% water.

The starch used was a dispersion of potato starch in water, 1½%. The starch solution contained 0.25 wt. % caustic soda to aid starch dispersion. The amine used was commercially available from Westvaco Corporation as Amine 9AG, and was used as a 5% solution with kerosene. This is a well-known amine collector used in many phosphate flotation operations in the United States. The use of a kerosene extender is conventional in commercial phosphate flotation. In most of Examples 1–6 the concentrate recovered amounted to about 30% of the feed, and the tailings amounted to about 70% of the feed.

For Example 1, utilizing laboratory flotation facilities, the feed analyzed 19.6% BPL, dry basis. It was fairly coarse, having a screen analysis of 2% by weight on 20 mesh, with 5% through 150 mesh. The balance of 93% was sized between 20 mesh and 150 mesh. The feed was stirred or mixed with water for approximately 30 seconds to give a homogeneous aqueous slurry. Enough water was used to bring the solids down to about 60%. Then 20 drops of starch solution was added. After the starch addition, amine was added, namely, 8 cc. of amine plus 8 drops of kerosene and conditioned, i.e., stirred, for approximately 30 seconds. This reagentized pulp was then placed in the laboratory flotation cell. The tailings began to float almost immediately, whereas the phosphate particles stayed at the bottom of the cell. At this point additional amine (2 cc.) and kerosene (2 drops) was added to the remaining pulp in the laboratory cell for further beneficiation. The phosphate concentrate was recovered in the underflow and was found to analyze 67.8% BPL with 5.2% silica. The tailings analyzed 2.9% BPL and 94% silica. Recovery of BPL in the concentrate was 88.9%.

Example 2 was carried out in the same manner as Example 1 except that the amine/kerosene was added in one stage, namely as 10 cc. of amine plus 10 drops of kerosene. The concentrate analyzed 68.2% BPL, and BPL recovery was 92.5%.

Example 3 was carried out in the same manner as Example 2 except that no starch was used. This test was thus a control. The concentrate analyzed 51.5% BPL, and recovery was only 24.6% BPL.

Examples 4, 5, and 6 reported below were carried out in a fashion similar to that of Example 2, except that the feed analyzed 38.8% BPL; also the amount of starch was varied. In all three tests, Nos. 4, 5, and 6, the amine was added in the same manner as Example 2.

In Example 4, 10 drops of starch solution was used. The concentrate analyzed 75.6% BPL; recovery was 79.2% BPL. In Examples 5, 20 drops of starch solution was used. The concentrate analyzed 67.8% BPL; recovery was 95.0% BPL. In Example 6, 40 drops of starch solution was used. The concentrate analyzed 67.8% BPL; recovery of BPL was 94.5%.

EXAMPLE 7, Plant Scale Use—2-cell Variation

In the United States, practically all phosphate flotation is carried out commercially using two flotations in series, viz., a rougher and a cleaner. In this operation the incoming flotation feed is first conditioned with a fatty acid-fuel oil mix. This coats the phosphate particles. The phosphate particles float in the first series of flotation cells, while the silica sinks. The silica is sent to tailings. The rougher concentrate which has floated is then phased through a weak solution of sulfuric acid to remove the fatty acid and fuel oil coating. This rougher concentrate contains some unwanted silica. To remove most of this unwanted silica, the rougher concentrate is conditioned with an amine/kerosene mix. The amine coats the silica, which becomes a float in the second series of flotation cells. The phosphate is recovered as purified underflow. See Kirk-Othmer, *Encyclopedia of Chemical Technology,* 2d Ed., 9, 394.

Although a single-cell flotation system is sufficient for operation of my invention, nevertheless the invention can be readily adapted to the existing double flotation cell equipment available in the traditional American phosphate flotation plant.

In this connection reference is made to the Figure. The crude phosphate feed leaves the screw classifier shown at 1. At this point it consists of a slurry containing about 70% solids. This slurry falls on moving weigh belt 2. The belt carries the slurry to conditioning tank 3 (about 4000 gal. capacity). Here the incoming feed is mixed with starch solution (which contains 1.5–2.0%/-starch and 0.25% caustic soda dispersed in water). The addition of the starch solution brings the solids content of the slurry down to about 60%. This reduction in solids is actually desirable, since I have found that this solids level works very well to disperse the starch solution onto the phosphate particles. If need be, additional water is added to bring the solids level down to about 60%. After the starch has been allowed to coat the phosphate feed thoroughly, the feed is transferred to the next conditioning vessel 4 (4000 gal.) where amine is added. Generally the amine will be extended with kerosene and/or oil. The amine/kerosene/oil mixture is the same as is currently used conventionally in most of the phosphate flotation operations in the United States. Retention time in the conditioner vessels is kept to a minimum to avoid formation of slimes. The conditioned feed now proceeds to the first series of flotation cells shown at 5. This bank of cells in a fair size plant may consist of a total of 6 to 12 cells, in pairs. In the plant in question, it consisted of 2 circuits of 3 cells each, 3 Denver and 3 M.S. The flotation equipment is conventional. Water is added as needed to maintain cell level. In the work reported below, the first bank of flotation cells was of the M.S. (Mineral Separation) and Denver varieties. Both varieties of these cells are in use and well-known in the phosphate industry. Silica tailings rise up and are swept out into edge landers by paddles, and are flushed away as tailings, shown at 6, and sent to the general mill tailing sump. The sink material comprises the phosphate particle concentrate. It is recovered as underflow at 7. At this point the concentrate is dewatered slightly in a dewatering cyclone (not shown) to bring the solids content up to about 70%, and more amine collector can be added. The thus treated rougher concentrate now passes to the second series of cells, which in the work herein described was a set of M.S. cells using self-induced air, i.e., 2 circuits of 1 cell each, both M.S. The sink float procedure here is identical to that in the preceding cells. Silica tailings are recovered as overflow at 8 and the concentrate underflow at 9. The underflow is dewatered in a dewatering cyclone and sent to concentrate loading bins for storage and/or shipment.

Using the above double flotation system a number of runs were made. The feed analyzed 30% BPL. In some of the runs the rougher concentrate analyzed 60% BPL, the tailings 4–6% BPL, for a 90% recovery of BPL. In Example 7-a this rougher concentrate was sent to the second bank of cells where it yielded a concentrate analyzing 75% BPL, the tails analyzing 30% BPL. Recovery of BPL in this second stage was also 90%. The overall recovery for both stages was thus $0.9\times0.9=81\%$. Example 7-a is typical of a few of the lower recoveries. Most of the runs gave much better results. Higher recoveries are described in Example 7-b as follows: A product analyzing 98% recovered BPL was obtained in the first stage. This was sent to the second stage where the product obtained analyzed 92 to 94% BPL recovery. Thus the overall recovery in this run was the product of the two recoveries, or 90–92% of the BPL in the initial feed. In another run, Example 7-c, there was 96% recovery of BPL in the rougher concentrate, followed by 96.5% recovery in the cleaner concentrate, and an overall recovery of 92.6% BPL, based on BPL in the starting feed. In another run, Example 7-d, the rougher concentrate recovered 94.7% BPL and the cleaner concentrate 97.9% BPL, thus giving an overall recovery of 92.7% of the starting BPL.

Passing the rougher concentrate through a second cleaner step reduces overall phosphate recovery slightly but improves BPL content in the final cleaner concentrate. BPL in these cleaner concentrates was typically 65 to 80%.

EXAMPLES 8a–8f, Plant Scale Use; 1-Stage Variation

The use of two flotation stages is actually unnecessary, since excellent results are readily obtainable using only the first bank of cells above described. The concentrate from the first bank thus becomes the final product. It is sent directly to the dewatering cyclone and thence to storage or shipment. Besides simplicity, such "once-through" process offers substantial savings in the way of capital equipment, power requirements, reagents, and maintenance. Using only the bank of Denver cells, with the feed described in Example 7, I have obtained (Example 8-a) a concentrate analyzing 79.8% BPL, for a BPL recoveryzof 91%. A similar run (Example 8-b, feed, 22.0% BPL) gave a 93.1% BPL recovery. Also (Example 8-c), a 39.9% BPL feed gave a 95% BPL recovery.

In using the single stage process, and sampling over a 3-day period, (Example 8-d) feed analyzing 19.7% BPL gave a recovery of 83%; and (Example 8-e) feed analyzing 16.8% BPL likdwise gave an 84% recovery of starting BPL. In Example 8-f feed analyzing 22.7% BPL gave a 93% recovery.

Two series of runs were made in the commercial plant. One series (Examples 9-a and 9-b) was made using high grade feed (averaging 35.4% BPL) and the second series (Examples 10-a and 10-b) was made using low grade feed (averaging 19.6% BPL). The runs were carried out in the following manner. The process of this invention was used in one series of cells (the Denver cells, see supra) and the old 2-stage process was used in the M.S. cells (see supra). The M.S. cells comprised three rougher cells and one silica cell. There were three cells in the Denver series, used as rougher silica cells in parallel with one M.S. cell used as a final silica cell.

The first series extended over a period of 12 days, and during this time 14 samplings were taken. The same feed was fed to both the Denver cells and to the M.S. cells. The average BPL recovery in the Denver cells was 85.4%, (Example 9-a) comparing to 69.1% for the M.S. cells (Example 9-b). The final product of the Denver cells (Example 9-a) analyzed 70.3% v. 74.2% for the BPL in the M.S. product (Example 9-b).

In the second series of runs, extending over an 8-day period, 10 samplings were made. The percent of BPL recovery was 70.8% for the product in the Denver cells (Example 10-a), compared to 41.5% for the product of the M.S. cells (Example 10-b). BPL in the Denver product was 59.0% (Example 10-a) as compared to 67.2% in the M.S. cells (Example 10-b). All values for the two series of runs are averages for the stated samplings.

Materials and Reagents

The Feed

A wide variety of phosphate ore feeds can be used. The feed can be, but need not be sized, i.e., classified. Fairly coarse material can in fact be used. The BPL of the feed is believed variable between 5 and 45%, and higher. I have actually used feeds as low as 9% BPL and as high as 40.0% BPL, with satisfactory results. The run using 9% BPL feed is actually poorer in BPL than the tailings (12–14% BPL) in the prior art conventional process. Hence it is my information and belief that the older type of tailings can be used as feed in the process of my invention. Preferably the feed is the product from a phosphate rock treatment plant which includes a desliming operation. Such material contains generally 60–75% solids. Most of the work reported herein uses two grades of feed. One grade is a low grade material analyzing typically 10–25% BPL. The other grade is a high grade material analyzing typically 20–45% BPL. Intermediate grades have also been used with success.

The Cationic Reagent (e.g., Amine)

Various cationic reagents can be used. Any of the conventionally used amines for the flotation of silica from phosphate ores are suitable, e.g., Westvaco Corp.'s AG amine as used in Example 1. Also, I have used successfully an amine available commercially from Ashland Chemical Company under the trademark designation MG-3014.

The cationic reagents disclosed in U.S. Pat. No. 3,349,903 are also suitable. These include a mix of C14–C18 aliphatic amines, with and without added rosin.

Additional suitable amines are listed in Table I below.

The amine, from whatever source, is preferably used as a solution of amine in kerosene/oil extender, in the known manner.

Caustic Soda

It is preferable to use caustic soda in helping to disperse the starch. When caustic soda is used the amount can vary, but a suitable amount is 0.5 weight percent based on the incoming starch solution.

Starch

A large number of starch materials is available. Potato starch is the easiest to use, because it dissolves readily in cold water. Cornstarch is less expensive but is more difficult to dissolve. Generally, it must be heated to effect dissolution. The preferred amount of starch is given in Table II below. Excess starch requires excess amine, and also may tend to coat silica thereby inhibiting it from floating.

The type of starch is not considered critical. Included among suitable starch materials (besides potato and corn, already mentioned) are:

1. The cereal starches; wheat, sorghum, rice.
2. Other plant sources; tapioca, sago, guar, arrowroot.
3. Modified starches; thin-boiling, oxidized, dextrins, British gums.
4. Starch derivatives; ether-, ester-, hydroxy-alkyl starch ethers, starch acetate, starch phosphate.

The starch can be in substantially any physical form. Typical is pearl starch, i.e., starch ground as it comes from the drier.

Water

Process water, substantially neutral, can be used. Deep well water is unnecessary. As in the conventional system of flotation, the water, from whatever source, should be substantially free of turbidity, since turbidity increases the amine requirement. It is a substantial advantage to be able to use hard water in this invention. In the conventional phosphate rock flotation process, using a fatty acid first stage to coat the phosphate rock particles, followed by an amine stage, it is well known that hard water is difficult to use because the alkaline earth metal ions, e.g., Ca and Mg, tend to react with the fatty acid anion to form soaps. Since this instant process does not require fatty acid, there is no problem with regard to consumption of reagent by soap formation.

TABLE I

AMINES

| Trade Designation | Description | Usual Method of Feeding | Usual Quantity Fed Lbs./ton |
|---|---|---|---|
| Alamac | Acetate of tallow amine | 5% water solution | .10–.50 |
| Alamine 26 | A tallow amine | 5% water solution | .10–.50 |
| Aliphat 44-A | Double distilled tall oil fatty acids primarily oleic and linoleic | Undiluted liquid | .5–2.0 |
| Amine 220 | A mixture of high molecular weight amines | 5% solution | .10–.50 |
| Armac 12-D | Distilled N—dodecylamine acetate. Laurylamine acetate | 1–5% water solution | .05–1.00 |
| Armac 16-D | Distilled N—hexadecylamine acetate. Palmitylamine acetate | 1–5% water | .05–1.00 |
| Armac 18-D | Distilled octadecylamine acetate stearylamine acetate | 1–2–5% water solution | .05–1.00 |
| Armac CD | Distilled primary amine acetate derived from cocoanut fatty acids | 1–5% water solution | .05–1.00 |
| Armac SD | Distilled primary amine acetate derived from soya fatty acids | 1–5% water solution | .05–1.00 |
| Armac TD | Distilled primary amine acetate derived from tallow fatty acids | 1–5% water solution | .05–1.00 |
| Armac HTD | Distilled primary amine acetate derived from hydrogenated tallow fatty acids | 1–2.5 water solution | .05–1.00 |
| Armeen 18-D | Distilled primary | In isopropyl | .05–1.00 |

TABLE I-continued

AMINES

| Trade Designation | Description | Usual Method of Feeding | Usual Quantity Fed Lbs./ton |
|---|---|---|---|
| | N—hexadecylamine. Palmitylamine | alcohol or kerosene solvent | |
| Armeen CD | Distilled primary amine derived from cocoanut fatty acids | Liquid or in isopropyl alcohol or kerosene solvent | .05-1.00 |
| Armeen SD | Distilled primary amine derived from soya fatty acids | Liquid or in isopropyl alcohol or kerosene solvent | .05-1.00 |
| Armeen TD | Distilled primary amine derived from tallow fatty acids | In isopropyl alcohol or kerosene solvent | .05-1.00 |

The following Table gives preferred and typical ranges for the reagents.

TABLE II

| Reagent | Lbs. per ton of phosphate rock ore feed (dry basis) (Recommended range) | Typical Values (1) | (2) |
|---|---|---|---|
| Starch | .150 to .250 | 0.08 | 0.08 |
| NaOH | .040 to .050 | 0.01 | 0.01 |
| Amine | 1.0 to 1.8 | 1.11 | 0.41 |
| Kerosene | 2.5 to 3.0 | 3.25 | 2.09 |
| Fuel Oil | 2.0 to 2.8 | 0.70 | 0.70 |

(1) For a feed with BPL in the range of 10 to 25%.
(2) For a feed with BPL in the range of 20 to 45%.

The Flotation Cell

It is my experience that a cell using induced air (in contrast to the use of forced air) is superior for operating this invention. A large quiescent cell which causes very little turbulence is best. The operation at this point should be free from turbulence because turbulence disperses clay into the system, causing a substantial increase in the amount of amine required.

EXAMPLE 11

Mixing Tailings with Slimes

The silica tailings emerging from the use of this process are "reagentized" with starch and amines. If the tailings are disposed of without further treatment (and this is, of course, possible) they make a very spongy disposal product. On the other hand a much firmer product can be made, and simultaneously an additional benefit can be obtained, if a certain amount of slimes from the ore preparation section is added to the tailings. The slimes can be flowed by gravity into the general mill tailing sump. The amine and the starch react with the phosphate and the clay in the slimes and flocculate the slimes. This mix can then be pumped to the disposal area. The amount of slimes can vary. I have used 10%, based on the amount of tailings. In the commercial operation as described in Example 7, tailings in the amount of 350 tons per hour are produced. In the preceding part of the plant, about an equal amount of slimes is produced, containing 4–5% solids. Thus I take 10% of the total slime output, or about 35 tons and bring it back into the general mill tailing sump. Higher amounts can be added. By this mixing procedure I decrease by, e.g., 10%, the amount of slimes that would have to be sent to slime retention ponds, thereby saving a concomitant expense, since the amount of dams and retaining walls is correspondingly reduced by 10%.

The above examples are based on work and experiments actually performed. Unless otherwise noted, the remaining discussion and description is based on information and belief.

I claim:

1. The method of reverse flotation for silica-containing phosphate rock ore, comprising adding potato or corn starch to the ore to depress phosphate rock particles, followed by adding cationic reagent to float the silica, and recovering phosphate rock as sink concentrate and silica as float tailings.

2. The method according to claim 1 in which the ore is a rougher concentrate from a previous flotation.

3. In the flotation separation of phosphate values from silica gangue in crude phosphate ore pulps where a cationic collector reagent is used for the silica and the ore pulp is subjected to flotation to provide a phosphate concentrate and silica tailings, the improvement comprising first treating the ore pulp with potato or corn starch, then treating the ore pulp with the cationic collector, whereby phosphate concentrate is obtained as underflow and silica tailings are obtained as overflow.

4. The method according to claim 3 in which the ore pulp is a rougher concentrate.

5. In the method of recovering phosphate ore by flotation of a crude phosphate ore containing phosphate rock particles and silica, the improvement comprising conditioning the ore as a slurry with potato or corn starch followed by treatment of the ore pulp with an amine collector for silica, followed by flotation whereby the phosphate rock particles sink and are recovered as concentrate, and the silica floats and is recovered as tailings.

6. The method according to claim 5 in which the starch is potato starch.

7. The method according to claim 6 in which the starch is corn starch.

8. The method according to claim 5 in which the phosphate rock concentrate is recovered as a rougher concentrate and is further treated with additional amine and is further subjected to a flotation process for the recovery of phosphate rock particles as the sink cleaner concentrate and the silica is removed as float tailings.

9. The method according to claim 5 in which the initial phosphate ore feed analyzes at least 5% BPL.

10. The method according to claim 9 in which the feed analyzes 10–45% BPL.

11. Method according to claim 10 in which BPL recovery in the phosphate concentrate is at least 80% and the BPL content of the concentrate is 65–80%.

12. The method according to claim 5 in which silica tailings are admixed with slimes from a phosphate rock preparation source, whereby the amine and starch content of the tailings flocculates the clay suspended in the slimes and facilitates settling of the mixture.

13. The method according to claim 12 in which the slimes is about 10% of the tailings.

* * * * *